US007063024B2

(12) United States Patent
Latino

(10) Patent No.: US 7,063,024 B2
(45) Date of Patent: Jun. 20, 2006

(54) COMPUTER MONITOR LIFT AND STORAGE MECHANISM

(75) Inventor: Richard M. Latino, Sterling, MA (US)

(73) Assignee: Wright Line, LLC, Worcester, MA (US)

( * ) Notice: Subject to any disclaimer, the term of this patent is extended or adjusted under 35 U.S.C. 154(b) by 372 days.

(21) Appl. No.: 10/613,183

(22) Filed: Jul. 3, 2003

(65) Prior Publication Data

US 2005/0002155 A1 Jan. 6, 2005

(51) Int. Cl.
*A47B 37/00* (2006.01)

(52) U.S. Cl. ..... 108/50.01; 108/147

(58) Field of Classification Search ..... 108/50.01, 108/50.02, 147, 147.19; 312/223.3, 223.2, 312/223.6, 196, 194; 248/188.2, 162.1, 161; 345/905; 361/681, 683
See application file for complete search history.

(56) References Cited

U.S. PATENT DOCUMENTS 4,735,467 A * 4/1988 Wolters ..... 312/223.3
5,020,752 A * 6/1991 Rizzi et al. ..... 108/147
5,526,756 A * 6/1996 Watson ..... 108/147
5,682,825 A * 11/1997 Manner ..... 108/147
5,763,985 A * 6/1998 Asinovsky ..... 312/223.3
5,778,803 A * 7/1998 Machael ..... 108/147
5,797,666 A * 8/1998 Park ..... 312/223.3
5,927,213 A * 7/1999 Leday ..... 108/147
6,007,036 A * 12/1999 Rosen ..... 248/286.1
6,463,862 B1 * 10/2002 Kuhlman et al. ..... 108/50.01
6,556,678 B1 * 4/2003 Boyce ..... 379/454
6,609,465 B1 * 8/2003 Kolavo ..... 108/50.01
6,612,670 B1 * 9/2003 Liu ..... 312/312
6,733,094 B1 * 5/2004 Chang ..... 312/7.2
6,827,409 B1 * 12/2004 Michael ..... 312/223.3

OTHER PUBLICATIONS

Outwater Item #: TAB-404A Electronic Table Lifts w/ Remote Control: 3 Choices, Master Catalog "vol. 50"—p. #: 243, 1999-2003 Outwater Hardware Corporation.
Outwater Item #: TAB-100A Millennium Catalog p. #: 244, 1999-2003 Outwater Hardware Corporation.

* cited by examiner

*Primary Examiner*—Jose V. Chen
(74) *Attorney, Agent, or Firm*—Brian M. Dingman, Esq.; Mirick, O'Connell, DeMallie & Lougee

(57) ABSTRACT

A lifting mechanism for selectively lifting a computer monitor, and particularly a flat screen computer monitor, from below a desktop to a position on the desktop includes a stationary member including a linear slide mechanism, a vertically slideable support member sized and dimensioned to receive a computer display monitor and coupled to the linear slide mechanism, and a latch member. The vertically slideable support member is further coupled to a stored mechanical energy source such as a constant force compression spring, and is retained in a position below the desk by application of the latch member. When the latch member is released, the stored mechanical energy source causes the vertically slideable support member to move upward along the linear slide, through an aperture in a desk, until the computer monitor rests on a plane equivalent with the desktop. A deceleration mechanism is preferably also provided on the vertically slideable member, the declaration mechanism limiting the speed of the vertically slideable member as it approaches the end of the linear slide mechanism, thereby limiting the possibility of derailment.

16 Claims, 9 Drawing Sheets

COMPUTER MONITOR LIFT AND STORAGE MECHANISM

BACKGROUND OF THE INVENTION

The present invention is related to lifting devices for selectively displaying or storing equipment, and more particularly to a lifting mechanism for lifting a computer monitor to a desktop from beneath the desk.

As the need to access computers has increased, computers are increasingly found in meeting rooms, training rooms, and classrooms, as well as on office desks. While access to computers is important in all of these locations, the ability to provide an unrestricted view to a person sitting across a desk, toward a blackboard, or across a meeting table is also important, especially to allow for eye contact during a meeting, a discussion, or a lecture. Computer monitors, however, often unreasonably restrict this view, making it difficult for the computer user to see or be seen. Furthermore, computer monitors add significantly to clutter on a desk, making it difficult to use the work surface and often, therefore, causing a need for additional office furniture.

For these reasons, schools, businesses, and offices typically include at least one, and sometimes more, computer training labs or meeting rooms which are dedicated solely to computer training and use. These rooms provide a place for holding a meeting or training session in which a large number of people can each view a computer monitor, and are therefore important to computer training and application presentations, lectures, and meetings. These rooms, however, are also expensive, as they require a great deal of dedicated space, as well as significant maintenance and updating. Furthermore, although requiring a significant amount of resources, these rooms are often underused. It is desirable, therefore, to provide a system in which a computer can be selectively retrieved for use and, when not in use, can be easily and inexpensively stowed.

Another problem with computing equipment provided in offices, meeting rooms, and labs is that the equipment is portable, is typically not monitored very closely, and is, therefore, relatively easy to steal, providing both a financial and a security problem for schools and businesses. As computing equipment becomes increasingly small, and hiding the equipment therefore easier, these problems have increased. It is desirable, therefore, also to provide a method for easily and inexpensively stowing and locking computer equipment.

There remains a need, therefore, for a computer desk in which a computer can be selectively provided on the desk, or easily stored and locked.

BRIEF SUMMARY OF THE INVENTION

In one aspect, the present invention provides a computer monitor lifting device. The computer monitor lifting device comprises an equipment support, sized and dimensioned for receiving a computer monitor, and a lifting mechanism coupled to the equipment support and adapted to selectively move the equipment support and the computer monitor between a retracted position and an extended position. The equipment support is selectively coupled beneath a work surface in the retracted position and raised onto the work surface in the extended position.

In another aspect, the present invention provides a computer monitor lifting device including a work surface with an aperture, a stationary support provided beneath the work surface, a monitor support moveably coupled to the stationary support and sized and dimensioned to receive a computer monitor, and a lifting mechanism coupled between the equipment support and the stationary support. A latching mechanism selectively latches the monitor support to the stationary support, and the lifting mechanism is adapted to selectively lift the monitor support and the computer monitor through the aperture and onto the work surface when the latching mechanism is released.

In yet another aspect, the present invention provides a computer monitor lifting device for moving a computer monitor between a retracted and an extended position. The computer monitor lifting device comprises a stationary support member adapted to be coupled beneath a work surface, a computer monitor support slidably coupled to the stationary support member, a lifting device coupled to the monitor support, a latching mechanism for latching the computer monitor support to the stationary support, and a latch release mechanism for selectively releasing the latching mechanism.

The computer monitor support includes a top horizontal member and a bottom horizontal member, both of which are sized and dimensioned to be received in an aperture in the work surface. The top and bottom horizontal members are spaced vertically at a distance selected to allow a computer monitor to be received on the monitor support, a lifting device provides an upward lifting force directed against the weight of the monitor support when the monitor support is in the retracted position the latch release mechanism maintains the computer monitor support beneath the work surface in the retracted position. When the latching mechanism is released, the lifting mechanism drives the computer monitor support upward to the extended position, wherein the bottom horizontal surface rests in the aperture in the work surface and the computer monitor is displayed on the work surface.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
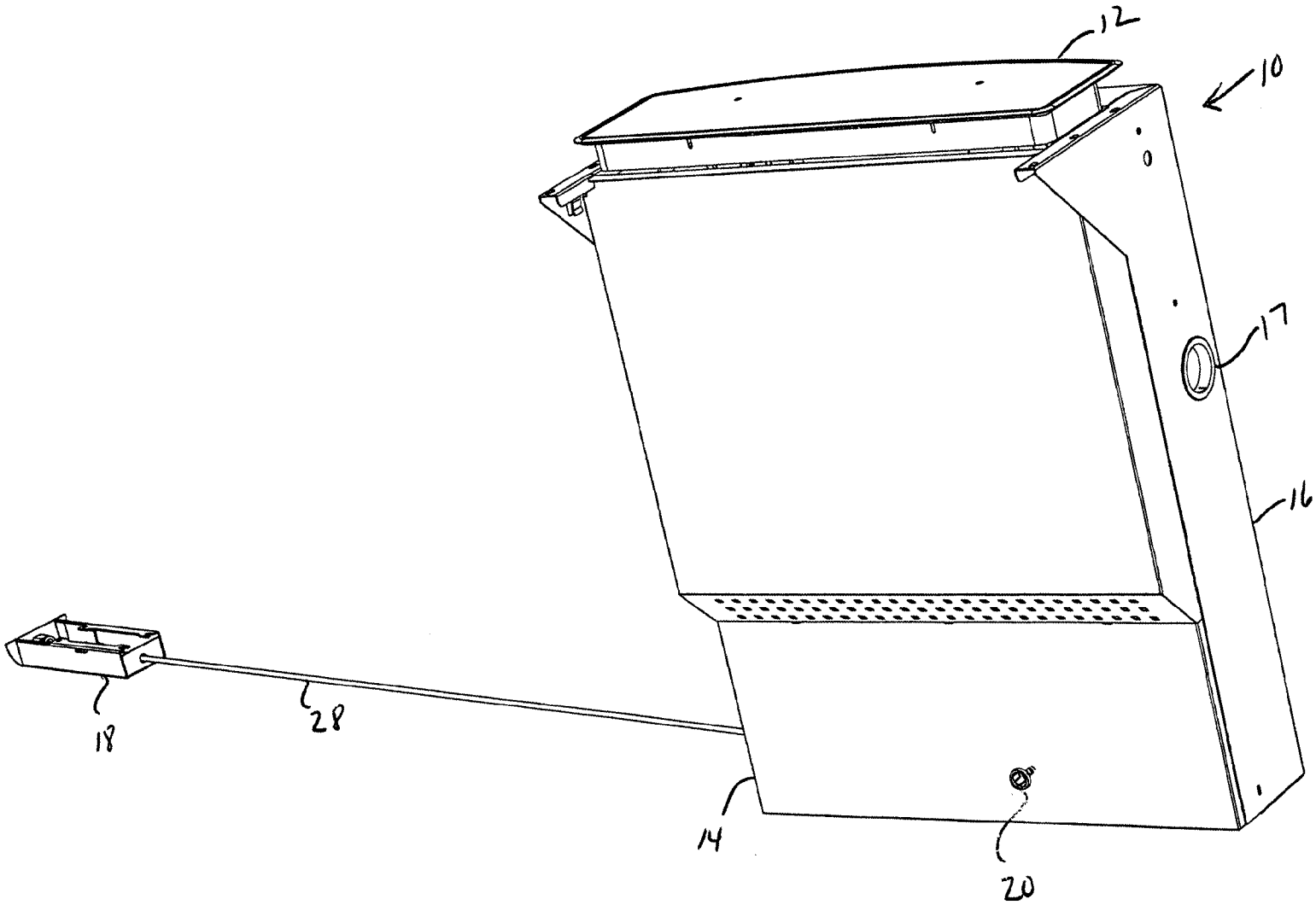
FIG. 1 is a perspective view of a computer monitor lift mechanism constructed in accordance with the present invention.
Figure 9:
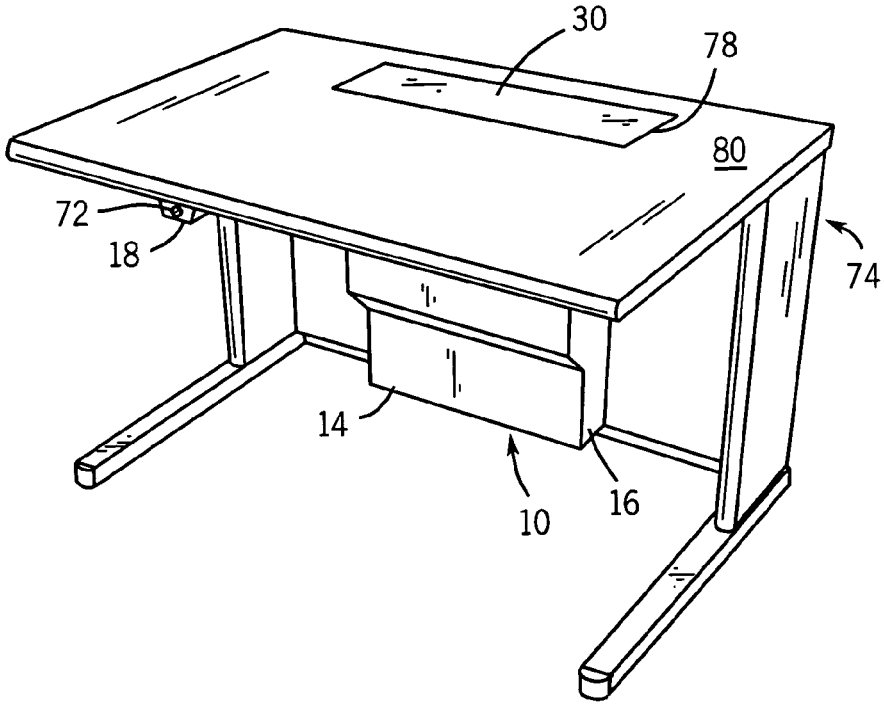
FIG. 9 is a perspective view of a desk including the computer monitor lifting device of FIG. 1, in a retracted mode.
Figure 10:
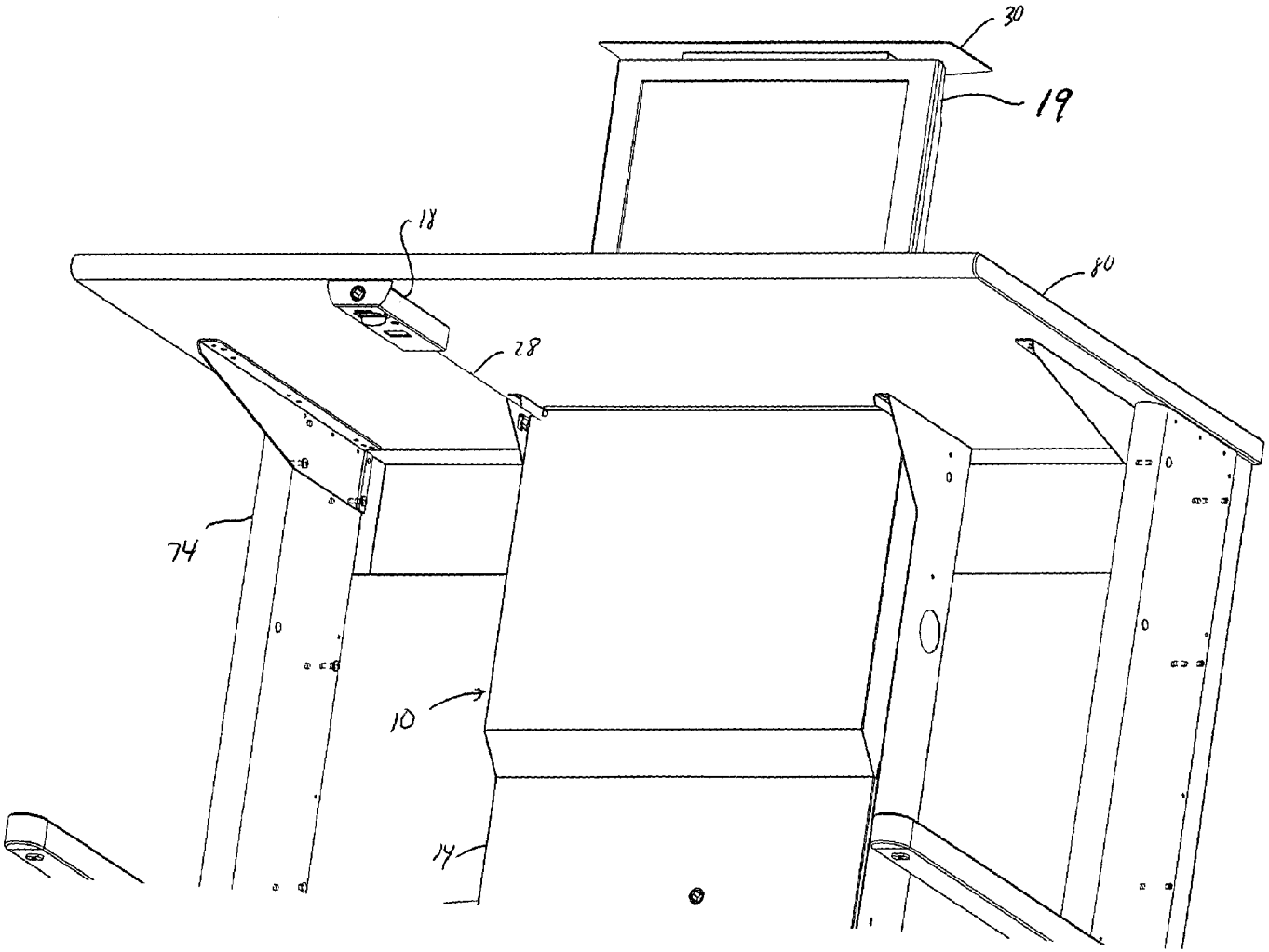
FIG. 10 is a perspective view of a desk including the computer monitor lifting device of FIG. 1 in an expanded mode, with a computer monitor installed.

Referring now to the figures and more particularly to FIGS. 1, 9, and 10 a computer monitor lifting mechanism 10 constructed in accordance with the present invention is shown. The computer monitor lifting mechanism 10 comprises a stationary under-desk support mechanism 16, a vertically slidable monitor support 12, a lockable monitor enclosure 14 and a latch release mechanism 18. As described more fully below, in use the under-desk support mechanism 16 is positioned beneath an aperture 78 (FIG. 9) in a desktop 80, and a computer monitor 19 (FIG. 10) is positioned on the monitor support 12. Upon release of the latch mechanism 18, the monitor support 12 slides vertically through the aperture 78 such that a computer monitor can be selectively stored beneath the desk 74 or on the desktop 80. When stored under the desk 74, the lockable mounting enclosure 14 secures the monitor to prevent damage or theft. An aperture 17 is provided in a side of the computer lifting mechanism 10 to allow for routing of electrical cables.

Figure 2:
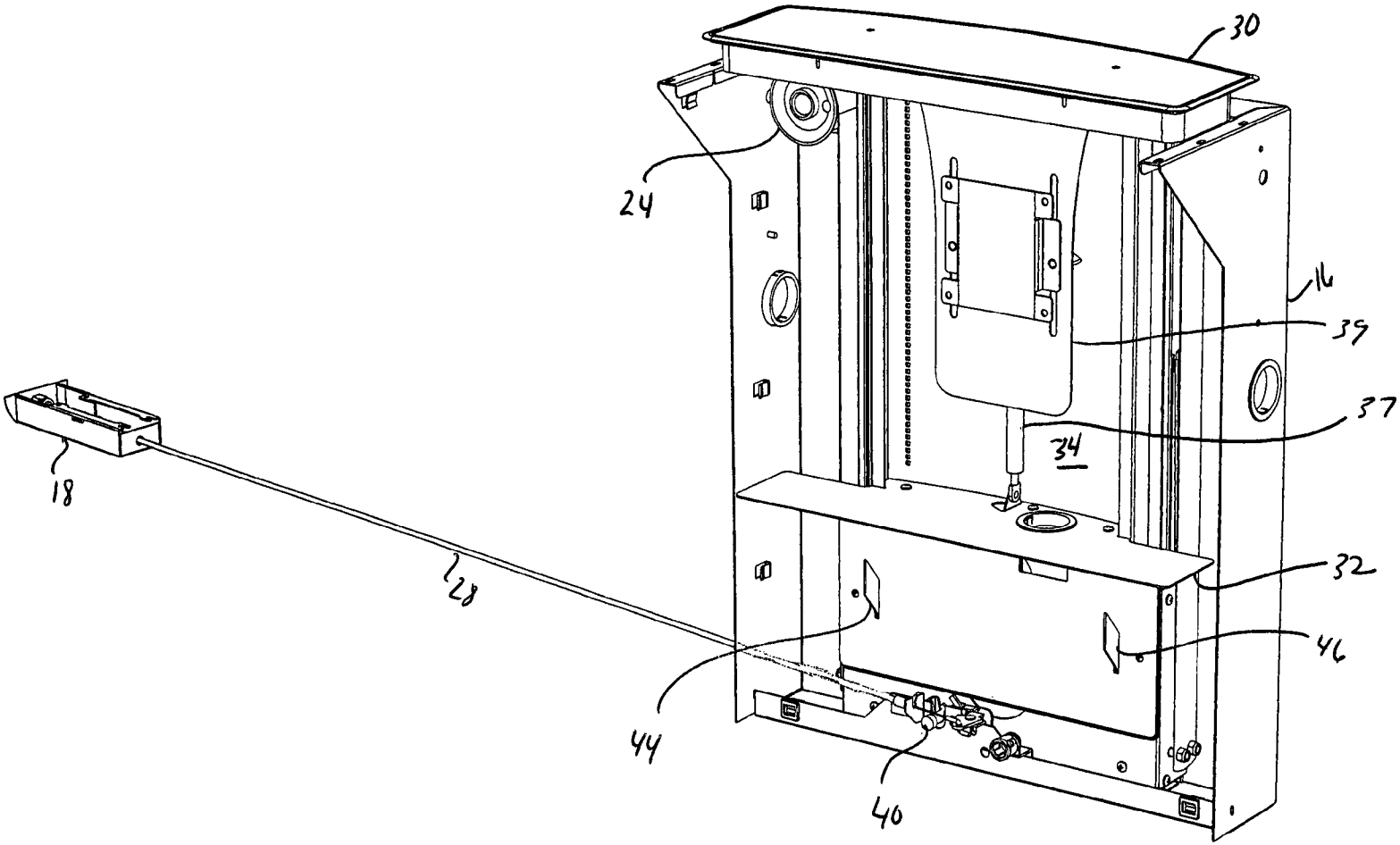
FIG. 2 is a view of the computer monitor lift mechanism of FIG. 1, with the lockable enclosure removed, in a retracted position.
Figure 3:
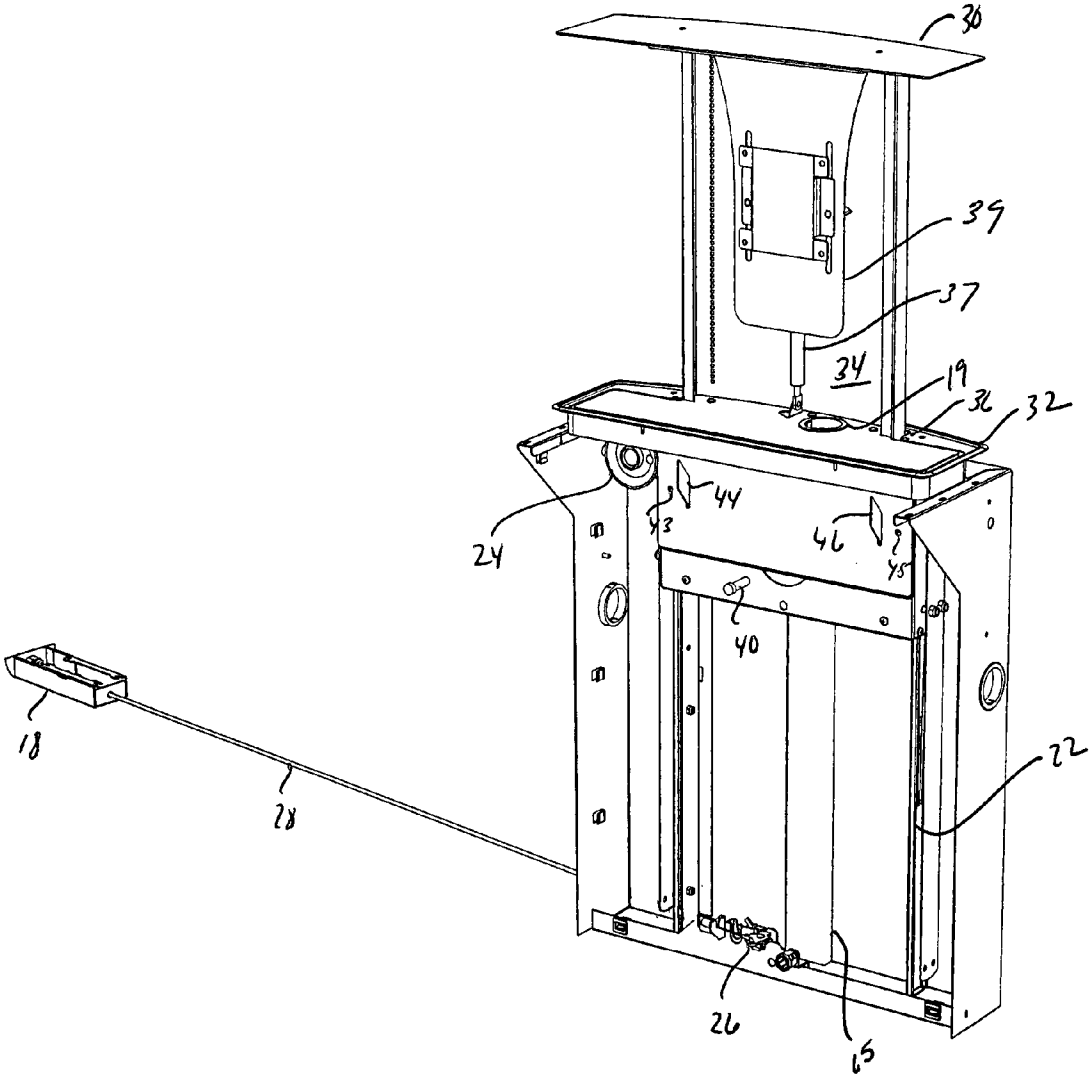
FIG. 3 is a perspective view of the computer monitor lift mechanism of FIG. 2, in an expanded position.

Referring now to FIGS. 2 and 3 the computer lifting mechanism 10 is shown with the lockable enclosure 14 removed and with the vertically slidable monitor support 12 in each of a retracted and extended position, respectively. The stationary under desk support structure 16 includes a linear slide mechanism 22 along which the monitor support 12 can be moved vertically, a constant force torsional coil spring 24 coupled to the monitor support 12, and a latching mechanism 26. In the retracted position, the latching mechanism 26 retains the monitor support 12 in place, counteracting the force of the coil spring 24. When the latching mechanism 26 is released, the coil spring 24 forces the monitor support 12 upward along the linear slide mechanism 22, effecting movement to the extended position. Electrical wiring is routed through an aperture 19 in the monitor support 12, thereby allowing the monitor 19 to remain connected to a computer provided, for example, below the flat surface, while in both the retracted and extended position.

Figure 4:
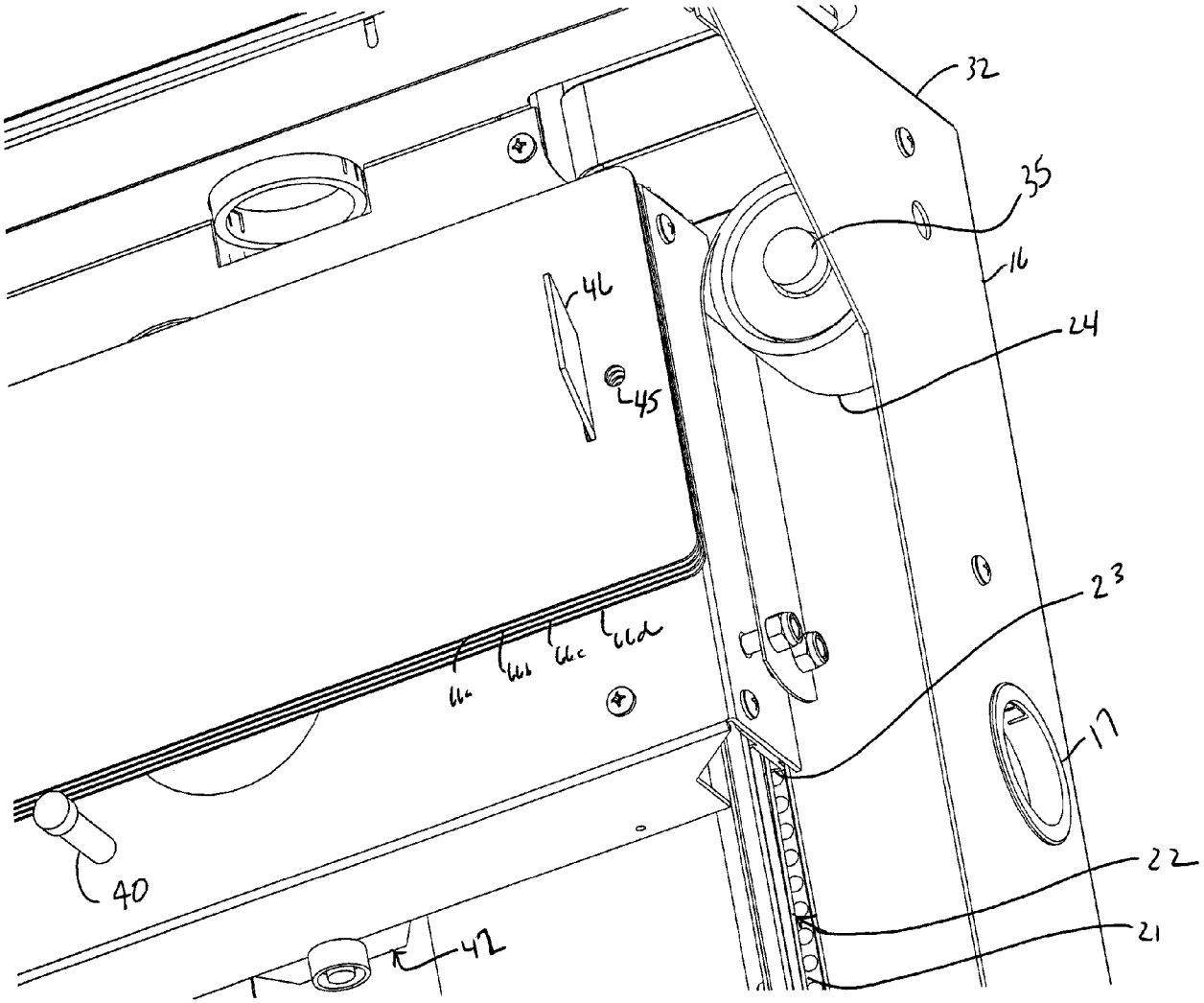
FIG. 4 is detail perspective view of the spring coil and linear slide mechanism.
Figure 7:
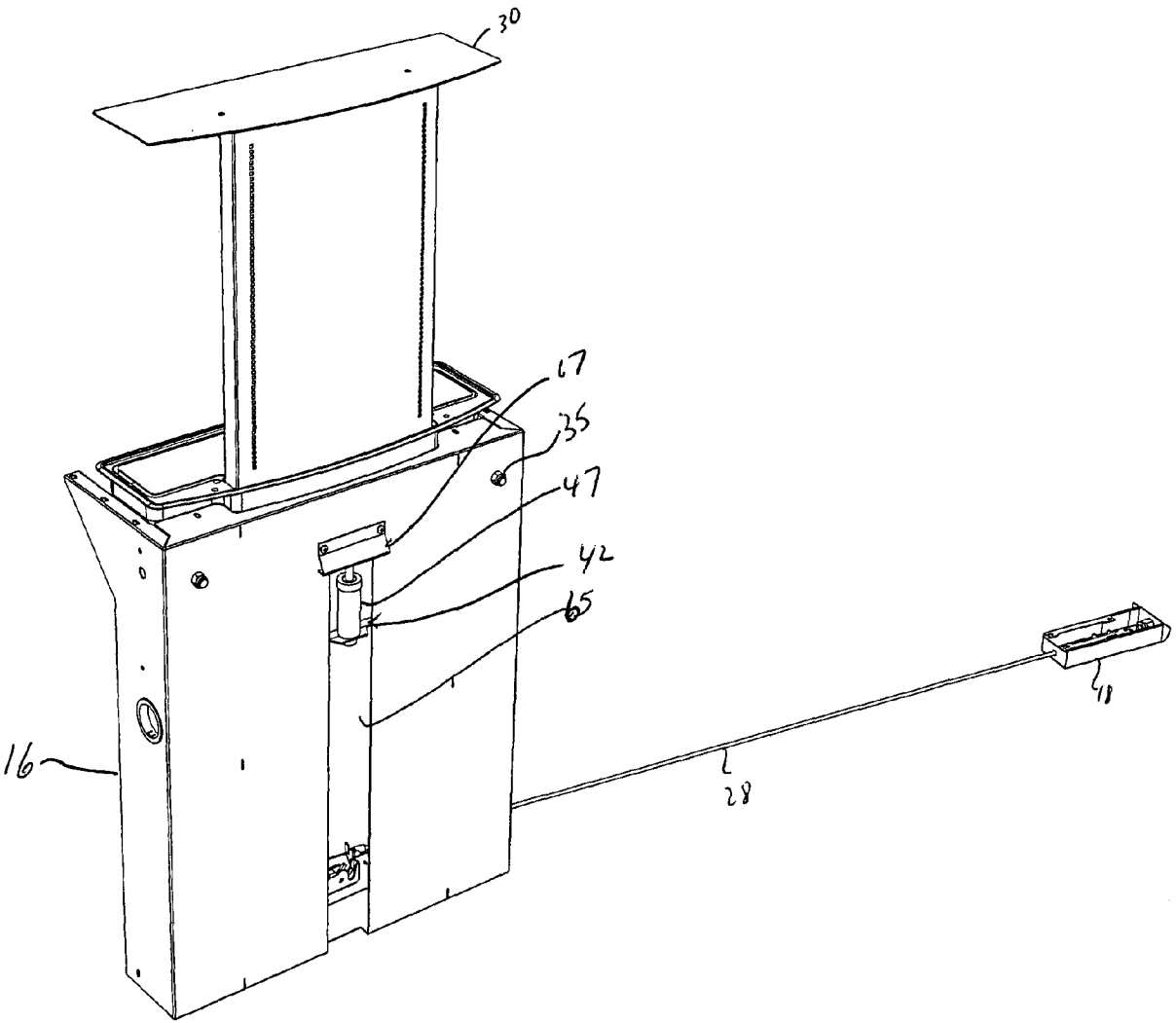
FIG. 7 is a back view of the computer lifting mechanism of FIG. 3 illustrating the brake.

Referring now also to FIG. 4, the linear slide mechanism 22 is a typical linear ball bearing drawer slide mechanism which includes a stationary mounting member 21 coupled to support structure 16, and a moveable rail 23 coupled to the monitor support 12. The rail 23 is sized and dimensioned to be received on and to move along the stationary mounting member 21. The monitor support 12 is further coupled to an end of the torsional coil spring 24 with fasteners 25 and 27. A strike pin 40 label in FIG. 4 for activating the latch mechanism 26 extends outwardly from the monitor support 12, as described below. The coil spring 24 is further coupled to the back wall of the stationary support with a threaded fastener 35 (FIGS. 4 and 7).

Referring still to FIGS. 2 and 3 the monitor support structure 12 comprises a substantially horizontal top plate 30 and a substantially horizontal bottom plate 32, each of which are sized and dimensioned to sit flat in the aperture 78 in the desktop 80, such that one of the top plate 30 and the bottom plate 32 covers the aperture 78 and is flush with the desktop 80 in each of the retracted and extended positions, respectively. The distance between the top plate 30 and the bottom plate 32 is selected to receive a flat screen computer monitor which rests on the bottom plate 32, and below the top plate 30. The top plate 30 and bottom plate 32 are coupled together with a substantially vertical back plate 34, the back plate 34 being rotatably coupled to the bottom plate 32 through a tilting mechanism 36 which allows the monitor to be rotated or tilted to provide a better viewing angle for a user when in the expanded position. A monitor mounting plate 39, including apertures for receiving fasteners for mounting the monitor to the monitor support 12 is coupled to the vertical back plate 34, and a pneumatic cylinder 37 is coupled between the bottom plate 32 and the monitor mounting plate 39 to provide stability.

Figure 5:
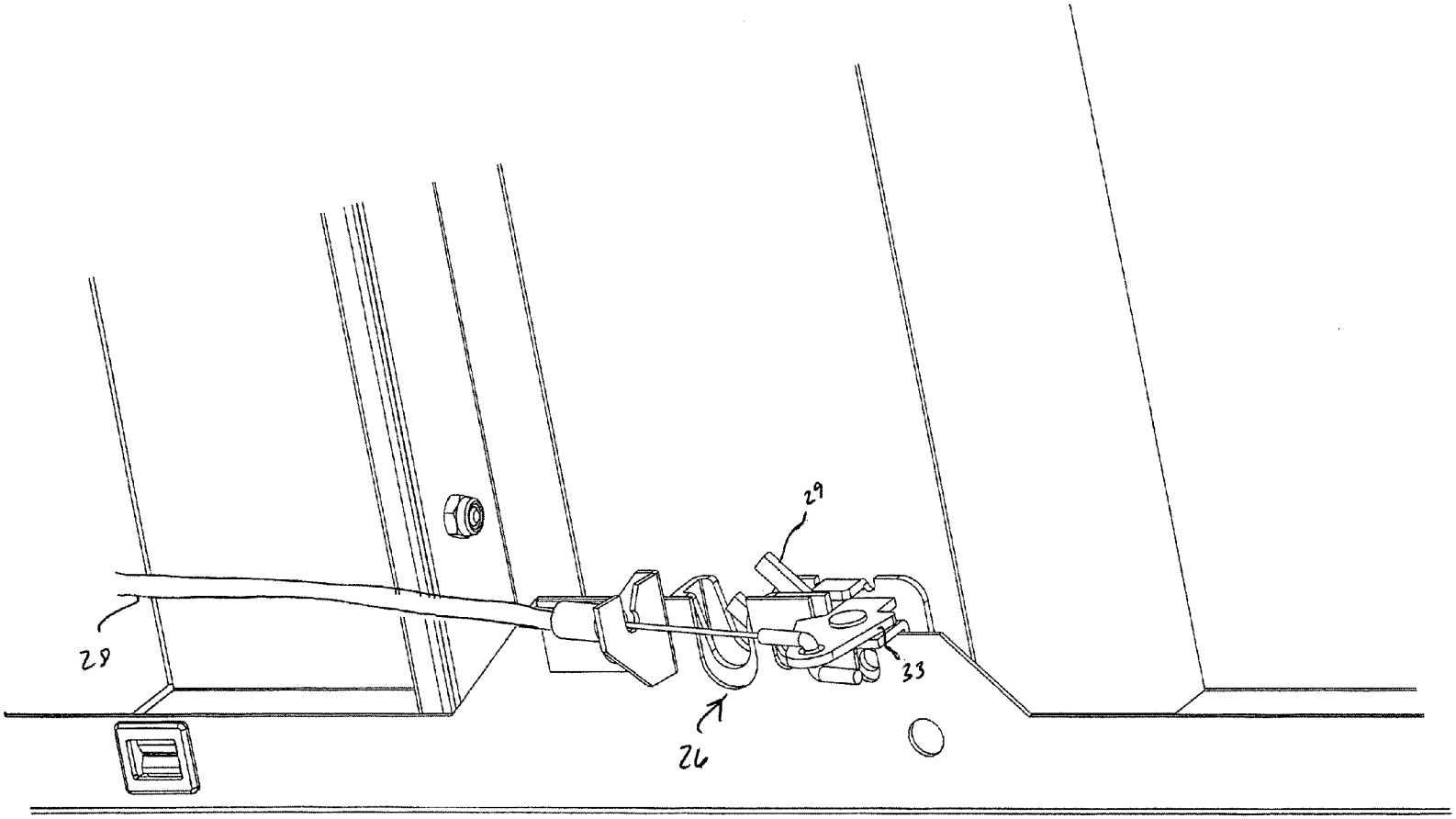
FIG. 5 is a detail perspective view of the latching mechanism.

As described above, a strike pin 40 is provided on the monitor support 12, beneath the bottom plate 32 and near a bottom end of the monitor support 12. Referring now also to FIG. 5, the strike pin 40 interacts with the down position latch mechanism 26 to latch the vertically slidable monitor support structure 12 in the retracted position. The latch mechanism 26 is a commercially available down position rotary type "slam" latch mechanism, including a rotatable latching member 29 which is moveable between a locked and an unlocked position. The rotatable latching member 29 includes a channel 31 sized and dimensioned to receive the strike pin 40, and is rotated to the locked position as the strike pin is pushed downward into the channel 31. A release mechanism 33 is coupled to a push-pull cable 28, which, referring again to FIGS. 2 and 3, is coupled to the latch release mechanism 18. When the push pull cable is activated, the release mechanism 33 is rotated horizontally to release the latching member 29 by allowing the rotational member to rotate upward to the position shown in FIG. 5.

Figure 6:
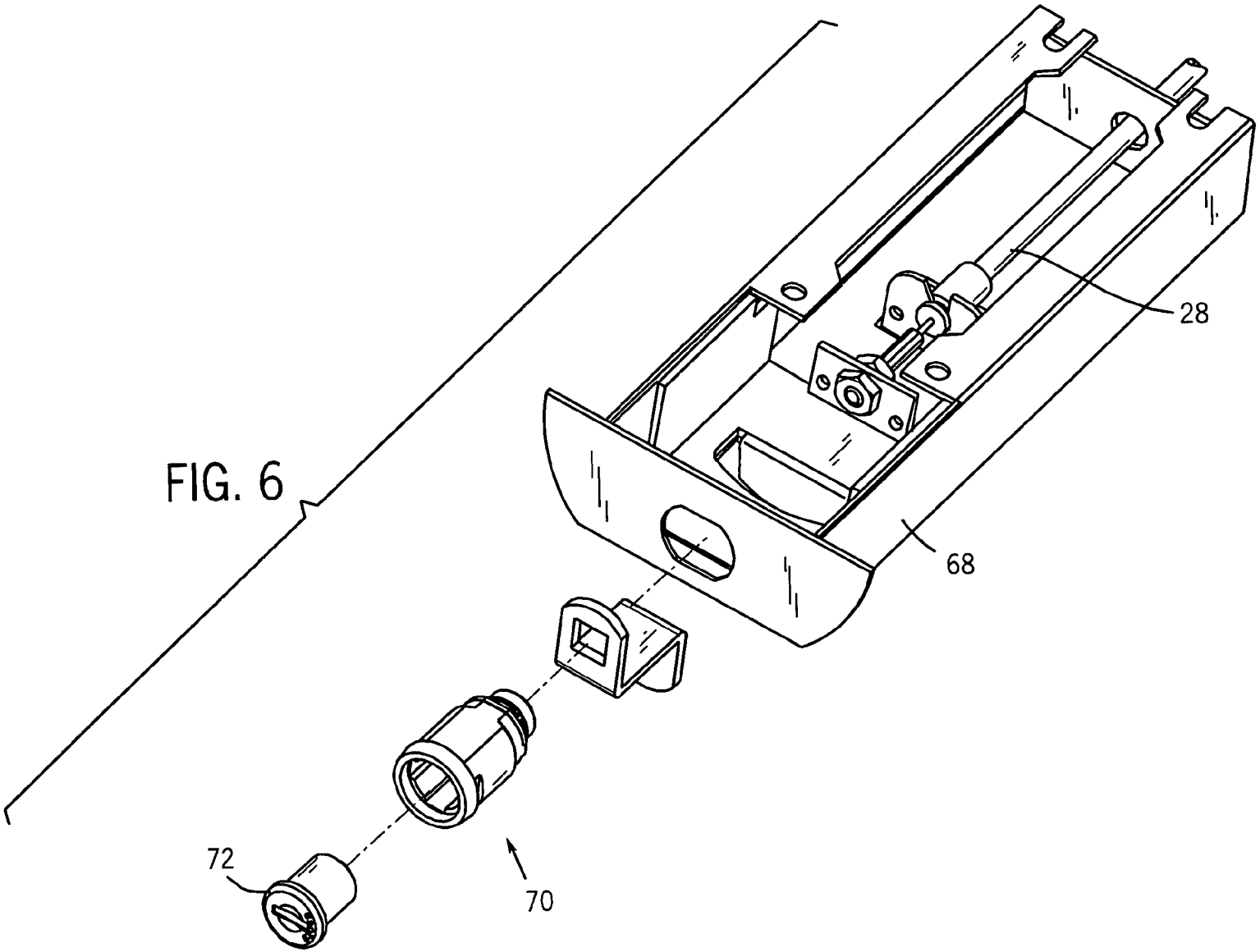
FIG. 6 is a perspective view of the latching release mechanism of FIG. 1.

Referring now to FIG. 6, the latch release mechanism 18 comprises a formed sheet metal channel 68 in which the push-pull cable 28 is provided. The push-pull cable 28 is coupled to a slidable release trigger 70 which is selectively operated by a key operated cam lock 72 which, when positioned in the locked position, impedes the movement of the release trigger 70. In the unlocked position, the lock 72 pulls on the cable 28 to release the latch mechanism 26, so the lift moves to the extended position. Referring again to FIGS. 2 and 3, as described above, the opposing end of the push-pull cable 28 is coupled to the release member 33 of the latch mechanism 26 in the stationary support 16, and is threaded through clips 51, 53, and 55 provided in the stationary support member between the latch mechanism and the latch release mechanism 18.

Figure 8:
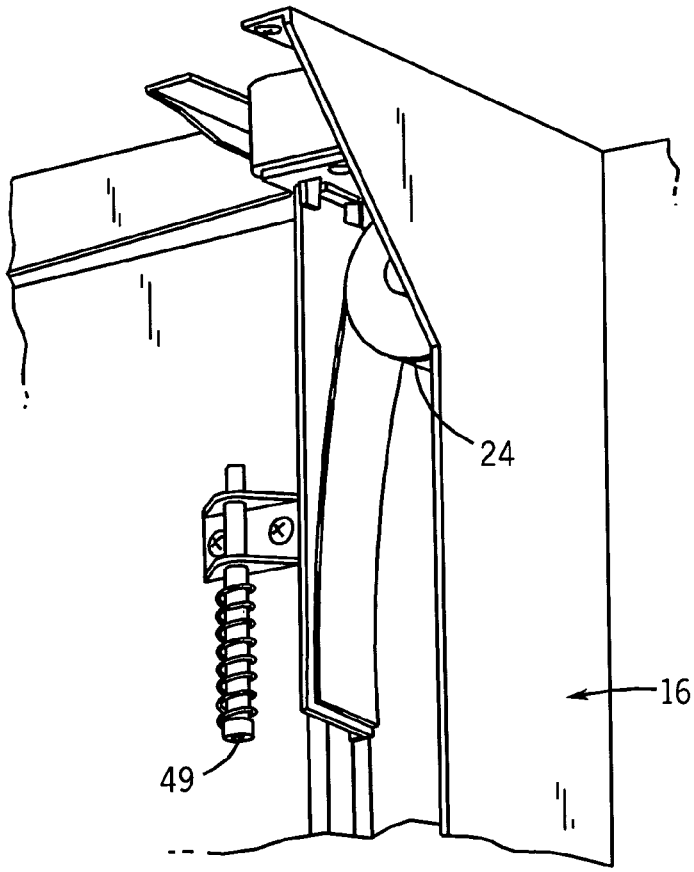
FIG. 8 is a perspective view of the front of the stationary support with the computer monitor support removed to illustrate a stop spring.

Referring now to FIG. 7, a back panel of the stationary support 16 includes a channel 65 including a flangular stop 67 near the top of the support 16. The channel 65 receives a deceleration braking assembly 42 including a commercially available shock absorber or snubber brake 47 coupled to a bracket 49 extending from the back of the monitor support 12, beneath the bottom plate 32. The deceleration braking assembly 42 moves through the channel 65 with the monitor support 12, and engages the flangular stop 67 at the top of the channel 65, decelerating the monitor support 12 as it approaches the end of motion. Referring now also to FIG. 8, the stationary support 16 can also include a spring loaded final stop point 49 to avoid final solid impact of the monitor support 12 if any residual force and movement remain due to insufficient deceleration.

Referring again to FIGS. 2 and 3 and also to FIG. 4, the monitor support 12 further comprises sheet metal counterweights 66*a*, 66*b*, 66*c*, 66*d* which are selectively added to the monitor support 12 below the bottom plate 32, slid onto brackets 44 and 46, and locked in place with threaded fasteners (not shown) received in apertures 43 and 45. The counterweights 66 are selectively applied to balance the weight of the computer monitor provided in the monitor support 12 against the force of the constant force torsional coil springs 24 and can be incrementally added to assure a relatively slow and smooth transition between the retracted and expanded positions.

Referring again to FIGS. 9 and 10, the computer monitor lift mechanism 10 is shown as mounted to a desk 74 including a work surface or desktop 80 with an aperture 78 in the top of the desk. The stationary support 16 of the flat screen computer monitor lift mechanism 10 is mounted to a back panel of the desk 74 extending from the desktop 80 toward the floor or other surface below, with the vertically slidable monitor support 12 aligned beneath and adjacent the aperture 78. The latch release mechanism 18 extends along, and parallel to, the bottom of the desktop 80 terminating near a front edge of the desktop 80 at a location easily accessible by a user.

After the computer monitor lift mechanism 10 is assembled as described above, the total weight of the monitor is determined and the number of required counterweights 66 (FIG. 6), if any, is selected such that the constant force torsional coil springs 24 (FIGS. 2 and 3) have a slight force advantage over the total weight of the system to be lifted. By controlling the weight appropriately, the vertically slideable monitor support 12 can elevate at a reasonably controlled speed. Furthermore, when the weight is properly selected, only a slight downward force is required to overcome the upward force advantage of the constant force torsional coil springs 24, and to re-seat the vertically slideable monitor support 12 into its down and stored position. Due to the linear force output curve of the constant force torsional springs 24, the force required to re-seat the mechanism remains minimal and constant throughout the mechanism's entire downward travel. Thus, re-seating of the slideable support member 12 into the down and stored position can easily be achieved from a sitting position.

When the stationary support 16, vertically slideable monitor support 12, latch release mechanism 18, and counterweights 66 are in place, the lockable enclosure 14 can be provided over the stationary support member 16 and monitor support 12 and locked in place to prevent theft or tampering with the computer.

To move the monitor from the retracted position beneath the desk 74 (FIG. 9) to the extended position (FIG. 10) on the work surface or desktop 80, the user activates the latch mechanism 18 by unlocking the trigger lock 72 and activating the slidable release trigger 70, which in turn activates the push-pull cable 28 causing the strike pin 40 to be released from the latch member 26 and allowing the constant force torsional coil spring 24 to drive the monitor support 12 upward through the aperture 78 to the extended position as shown in FIG. 10. In the extended position the bottom plate 32 rests in the aperture 78 and sits flush with the desk top 80 to provide a clean aesthetic finish for the desktop 80. As the vertically slidable monitor support 12 approaches the end of motion, the brake 47 engages the flangular stop 67 (FIG. 7) at the top of the channel 65 prior to the end of travel, causing the monitor support 12 to decelerate. A spring loaded final stop point 49 (FIG. 8) can be provided behind the vertically slidable mounting support 12 to avoid final solid impact of the mechanism if any residual force and movement remain due to insufficient deceleration. The brake 47 is reset when the slidable monitor support 12 is forced down and returned to its down and stored position.

The user returns the vertically slideable monitor support 12 to its down and stored position by manually pushing down on the top plate 30 until it seats flush with the aperture 78 in the desktop 80, as shown in FIG. 9. In the retracted position, the vertically slidable monitor support 12 is held below the aperture 78 by the strike pin 40 held in the latch mechanism 26 on the stationary support 16 (FIG. 2). The latch mechanism 26 counteracts the upward direction force of the constant force coil springs 24 to prevent the vertically slidable monitor support 16 from rising along the slide mechanism 22 until the latch mechanism 18 is again released by activation of the slidable trigger 70.

While a computer lift mechanism 10 as described above could be provided in a number of ways, in an illustrative embodiment, the computer monitor lift mechanism 10 is designed to support flat panel monitors having a weight range of from ten to twenty pounds and having a maximum size range equal to that of most commercially available monitors that are generically described as nineteen inches. The computer lift mechanism 10 is designed to vertically transition the supported flat panel monitor from the retracted, secured under-desk storage position to the extended, above-the-desk viewing position without any input from the user other that the operation of the release trigger 70. The power to elevate the monitor is derived from the stored energy source, here "constant force" torsional coil springs 24 (FIGS. 2, 3) and, as described above, is designed to have sufficient energy to lift the selected monitor while overcoming the weight and sliding friction of the vertically slideable monitor supporting structure 12 itself. Also described above, counterweights 66 (FIG. 4) can be selectively added to the vertically slideable monitor support 12 in the event that the mechanism is supporting a monitor having a weight of less than 20 pounds. The counterweights 66 can be provided in sheet metal, avoiding the necessity of expensive and complicated force adjustment mechanisms. Also avoided is the requirement of providing several different mechanism models with various weight capacity ranges. In the illustrative embodiment, the counterweights 66 are provided in one pound increments, which allows reasonably accurate setup for a monitor of the selected size.

As shown and described, the computer monitor support 10 includes two constant force torsional coil springs 24. The constant force torsional coil springs 24 are advantageous in that their force output remains constant throughout their entire operating range which results in a mechanism that is readily balanced, and has a uniform operating speed. These devices also have a cost advantage over alternative devices. The upward force, however, could also be derived from a number of commercially available energy storage devices such as compression springs, extension springs, or gas springs etc., which typically provide a non-linear force output curve, where the output force of the device is indirectly proportional to their linear displacement. Alternately, an electrically driven lead screw could be employed to provide power for both upward and downward translation of the mechanism. A quantity of at least two springs is advantageous in preventing the monitor from falling if one spring suddenly fails as the weight of the monitor and the vertically slideable monitor support 12 remains partially supported by the intact spring or springs 24.

As noted above, each of the linear slide mechanisms 22, the latching mechanism 26, the "push-pull" style coaxial cable, the slideable release trigger 70, trigger lock 72, and snubber brake 47 are all commercially available components. However, it will be apparent that similar devices could also be employed. For example, although linear ball bearing sliding mechanisms 22 are described, the slideable monitor support 12 could be guided by other similar means, such as guide bars and bushings, formed steel tracks, or other devices which will be apparent to those of skill in the art. Furthermore, although specific latching devices have been described, similar retention devices could be achieved by other commercially available or proprietarily designed latch mechanisms. Other deceleration devices, such as a friction brake could be used in place of the snubber or shock absorber described above. A similar result could also be obtained using one or more springs.

The monitor 19 (FIG. 10) is preferably attached to the tilting mechanism 36 via an industry standard VESA mounting plate. In the mechanism's down and stored position, the monitor 19 is stored in a vertical orientation with its viewing plane parallel with the mechanism's vertical plane of movement. This position allows the mechanism to be condensed into a minimum front to back dimension. This ultimately minimizes the amount of desktop or work surface space that is consumed by the mechanism's top plate and maximizes the amount of knee space under the desk. When the monitor is raised to its above-the-desk viewing position, the monitor may then be tilted to a comfortable upward viewing angle.

Although a specific embodiment has been illustrated and described, as noted above, the invention could be resized to accommodate monitors in larger or smaller ranges, including both flat screen and other monitor types. Additionally, while the computer lift mechanism 10 has been described for lifting a computer monitor, the device could also be applied for an entire computer set-up and/or printers or other peripheral devices, televisions, stereo systems, cameras, or other systems which are selectively displayed. Furthermore, although the device has been described for lifting a computer vertically from beneath a desk onto a desktop, a similar device could be provided for lowering a computer or computer monitor from an overhead storage location, or in other configurations.

It should be understood that the methods and apparatuses described above are only exemplary and do not limit the scope of the invention, and that various modifications could be make by those skilled in the art that would fall under the scope of the invention. To apprise the public of the scope of this invention, the following claims are made:

The invention claimed is:

1. A computer monitor lifting device for moving a computer monitor between a retracted and an extended position relative to a work surface, the computer monitor lifting device comprising:

a stationary support member coupled beneath a work surface;

a computer monitor support moveably coupled to the stationary support member, the computer monitor support including a fixed top horizontal member and a fixed lower horizontal member spaced below the top horizontal member, the top and bottom horizontal members being sized and dimensioned to at least mostly fill an aperture in the work surface, and spaced vertically at a distance selected to allow a computer monitor to be received on the monitor support between them;

a computer monitor coupled to the monitor support between the top and bottom horizontal members; and a lifting device coupled to the monitor support, the lifting device providing an upward lifting force directed against the weight of the monitor and the monitor support when the monitor support is in a retracted position.

2. The computer monitor lifting device as defined in claim 1, wherein the lifting device comprises a mechanical energy storage device coupled between the stationary support and the equipment support.

3. The computer monitor lifting device as defined in claim 2, wherein the energy storage device is a constant force coil spring.

4. The computer monitor lifting device as defined in claim 1, wherein the computer monitor support is moveably coupled to the stationary support through a linear slide mechanism.

5. The computer monitor lifting device as defined in claim 4, further comprising a latching mechanism coupled between the computer monitor support and the work surface to counteract the lifting mechanism and to retain the computer monitor beneath the work surface when in the retracted position.

6. The computer monitor lifting device as defined in claim 1, further comprising an enclosure for enclosing the computer monitor when the computer monitor is in the retracted position.

7. The computer monitor lifting device as defined in claim 6, wherein the enclosure is lockable.

8. The computer monitor lifting device as defined in claim 1, wherein the lifting mechanism comprises a constant force coil spring.

9. The computer monitor lifting device as defined in claim 8, wherein the constant force coil spring is retained in tension in a retracted position and is released to lift the computer monitor to an extended position.

10. The computer monitor lifting device as defined in claim 9, further comprising a latching mechanism that retains the constant force coil spring in tension when latched.

11. A computer monitor lifting device for moving a computer monitor between a retracted and an extended position relative to a work surface, the computer monitor lifting device comprising:

a stationary support member coupled beneath a work surface;

a computer monitor support slidably coupled to the stationary support member, the computer monitor support including a top horizontal member and a lower horizontal member spaced below the top horizontal member, the top and bottom horizontal members being sized and dimensioned to at least partially fill an aperture in the work surface, and spaced vertically and fixed relative to one another at a distance selected to allow a computer monitor to be received on the monitor support between them;

a computer monitor coupled to the monitor support between the top and bottom horizontal members;

a lifting device coupled to the monitor support, the lifting device providing an upward lifting force directed against the weight of the monitor and the monitor support when the monitor support is in a retracted position;

a latching mechanism for latching the computer monitor support to the stationary support; and a latch release mechanism for releasing the latching mechanism, wherein in the retracted position the latching mechanism maintains the computer monitor support beneath the work surface with the top horizontal member located within the aperture in the work surface, and when the latching mechanism is released, the lifting mechanism drives the computer monitor support upward to the extended position, with the lower horizontal member located proximate or within the aperture in the work surface, and the computer monitor and the top horizontal member located above the work surface.

12. The computer monitor lifting device as defined in claim 11, wherein the lifting device is a mechanical energy storage device held in tension while the computer monitor is in the retracted position.

13. The computer monitor lifting device as defined in claim 12, wherein the latching mechanism couples the computer monitor support to the stationary support and retains the mechanical energy storage device in tension.

14. The computer monitor lifting device as defined in claim 12, wherein the mechanical energy storage device comprises at least one of a constant force torsional coil spring, a compression spring, an extension spring, or a gas spring.

15. The computer monitor lifting device as defined in claim 11, wherein the computer monitor support is coupled to the stationary support with a linear ball bearing slide.

16. The computer monitor lifting device as defined in claim 11, further comprising a deceleration device coupled to the monitor support and activatable by a stop member coupled to the stationary support, wherein during upward movement of the monitor support the deceleration device contacts the stop member to decelerate the monitor support as the monitor support approaches the extended position.

* * * * *